US011746626B2

(12) United States Patent
Al-Obaidi et al.

(10) Patent No.: US 11,746,626 B2
(45) Date of Patent: Sep. 5, 2023

(54) CONTROLLING FLUIDS IN A WELLBORE USING A BACKUP PACKER

(71) Applicant: Saudi Arabian Oil Company, Dhahran (SA)

(72) Inventors: Ibrahim A. Al-Obaidi, Dhahran (SA); Suliman M. Azzouni, Dhahran (SA); Abdullah A. Alothman, Dammam (SA); Ali S. Abu Alsaud, Al Qatif (SA)

(73) Assignee: Saudi Arabian Oil Company, Dhahran (SA)

( * ) Notice: Subject to any disclaimer, the term of this patent is extended or adjusted under 35 U.S.C. 154(b) by 27 days.

(21) Appl. No.: 17/643,340

(22) Filed: Dec. 8, 2021

(65) Prior Publication Data

US 2023/0175361 A1 Jun. 8, 2023

(51) Int. Cl.

| | |
|---|---|
| ***E21B 43/12*** | (2006.01) |
| ***E21B 23/06*** | (2006.01) |
| ***E21B 47/10*** | (2012.01) |

(52) U.S. Cl.
CPC ..... *E21B 43/12* (2013.01); *E21B 23/06* (2013.01); *E21B 47/10* (2013.01)

(58) Field of Classification Search
CPC ..... E21B 43/12; E21B 23/06; E21B 47/10
See application file for complete search history.

(56) References Cited

U.S. PATENT DOCUMENTS

| | | | | |
|---|---|---|---|---|
| 385,600 | A * | 7/1888 | Durbrow | E21B 33/1277 175/323 |
| 3,601,188 | A | 8/1971 | McGlamety | |
| 4,700,778 | A | 10/1987 | Smith et al. | |
| 4,928,762 | A | 5/1990 | Mamke | |
| 4,953,617 | A | 9/1990 | Ross | |
| 5,048,613 | A | 9/1991 | Shilling | |
| 5,107,931 | A | 4/1992 | Valka et al. | |
| 5,129,453 | A | 7/1992 | Greenlee | |

(Continued)

FOREIGN PATENT DOCUMENTS

| | | | |
|---|---|---|---|
| CN | 102493782 | 6/2012 | |
| GB | 2355033 A * | 4/2001 | E21B 49/087 |
| WO | WO 2014168623 | 10/2014 | |

OTHER PUBLICATIONS

Sklet, "Safety barriers on oil and gas platforms: Means to prevent hydrocarbon releases," Thesis for the degree of doktor ingenior, Norwegian University of Science and Technology, Department of Production and Quality Engineering, Dec. 2005, 182 pages.

(Continued)

*Primary Examiner* — Steven A MacDonald

(74) *Attorney, Agent, or Firm* — Fish & Richardson P.C.

(57) ABSTRACT

Methods and systems for controlling fluids in a wellbore are described. The methods and systems include running a production string into the wellbore, the production string includes production tubing and completion components with a first packer with a first control line and a backup packer with a second control line; setting the first packer in the wellbore in response to a signal on the first control line; producing hydrocarbons from the wellbore with the first packer set and the backup packer unset; and setting the backup packer in the wellbore in response to a signal on the second control line.

8 Claims, 4 Drawing Sheets

(56) References Cited

U.S. PATENT DOCUMENTS 5,197,547 A 3/1993 Morgan
5,207,272 A 5/1993 Pringle et al.
5,598,894 A * 2/1997 Burleson ..... E21B 43/11852 175/4.54
5,613,560 A 3/1997 Jelinski et al.
5,698,799 A * 12/1997 Lee, Jr. ..... E21B 33/1243 175/21
6,298,916 B1 * 10/2001 Tibbles ..... E21B 34/14 166/149
6,464,006 B2 10/2002 Womble
6,571,877 B1 6/2003 Van Bilderbeek
7,036,602 B2 5/2006 Turley et al.
7,823,636 B2 * 11/2010 Lucas ..... E21B 33/128 166/387
8,733,458 B2 5/2014 Gambier et al.
9,279,307 B2 3/2016 Williamson
10,081,998 B2 9/2018 Tunget
10,370,943 B2 8/2019 El Nekhily et al.
10,408,013 B2 9/2019 Al-Mumen et al.
10,648,278 B2 5/2020 Al-Mumen et al.
10,815,751 B2 10/2020 Al-Mumen et al.
10,947,789 B1 3/2021 Al-Abdulrahman et al.
10,961,807 B2 * 3/2021 Foster ..... E21B 33/127
2008/0053652 A1 * 3/2008 Corre ..... E21B 33/1243 166/244.1
2008/0164027 A1 * 7/2008 Sanchez ..... E21B 43/04 166/278
2008/0202748 A1 8/2008 Bussear et al.
2008/0308282 A1 12/2008 Standridge et al.
2009/0159291 A1 * 6/2009 Rodger ..... E21B 17/01 285/96
2010/0175894 A1 * 7/2010 Debard ..... E21B 34/10 166/382
2010/0263856 A1 10/2010 Lynde et al.
2012/0067643 A1 * 3/2012 DeWitt ..... E21B 21/16 175/65
2014/0346772 A1 * 11/2014 Gutierrez-Lemini ..... E21B 19/002 285/302
2019/0153852 A1 * 5/2019 Lallemand ..... E21B 47/12
2019/0249512 A1 * 8/2019 Foster ..... E21B 33/12
2019/0368290 A1 12/2019 Vick, Jr. et al.
2020/0240265 A1 * 7/2020 Machocki ..... E21B 49/081
2021/0071481 A1 3/2021 Al-Abdulrahman et al.

OTHER PUBLICATIONS

U.S. Appl. No. 17/543,233, filed Dec. 6, 2021, Al-Obaidi et al.
U.S. Appl. No. 17/643,234, filed Dec. 8, 2021, Al-Obaidi et al.

* cited by examiner

CONTROLLING FLUIDS IN A WELLBORE USING A BACKUP PACKER

TECHNICAL FIELD

The present disclosure generally relates to barriers for controlling fluids in a wellbore, more particularly backup packers in a completion string.

BACKGROUND

Wellbore operations can be challenging, time-consuming, and costly. For example, a wellbore with corrosion can pose a challenge in delivering the wellbore. On the other hand, size constraints and fluid levels can prevent installing a plug in the wellbore.

Over the years, a significant amount of emphasis has been added on wellbore monitoring and operating. One focus has been on implementing methods to reduce the cost associated with wellbore construction and monitoring. For example, wellbore compliant drilling and workover rigs have been employed. However, these methods require multiple trips and additional equipment downhole which can be time-consuming and costly.

SUMMARY

This specification describes methods and systems for controlling fluids in a wellbore using a backup packer. The backup packer can serve as a barrier in a completion string to control the flow of fluids and extend the life of the wellbore. Initially, the backup packer on the completion string is placed unset/inactive at a shallow depth and remains inactive until it is needed to be run on wellbores in the future. To prevent permanently setting the backup packer the system includes a separate, second control line for the backup packer. The backup packer can be run and set electrically (e.g., actuated by using wirelines) or hydraulically by applying pressure through a separate, second control line. The backup packer can include an elastomeric protective sleeve that can be removed before running the backup packer. The sleeve can be shifted using a shifting tool and the packer would function as a backup packer at the time. The protective sleeve will allow the packer to last for the long run life of the wellbore. The backup packer can be a part of the completion assembly that is installed in the wellbore but remains inactive till is needed. This approach allows the backup packer to be left inactive in the hole for future use and for securing the wellbore long term.

Having a backup packer to control fluids in a wellbore can improve production rate, extend wellbore life, reduce the amount of equipment and trips that need to be run downhole, and prevent additional challenges associated with wellbore operations.

In some aspects, a method for controlling fluids in a wellbore includes running a production string into the wellbore, the production string has production tubing and completion components including a first packer with a first control line and a backup packer with a second control line; setting the first packer in the wellbore in response to a signal on the first control line; producing hydrocarbons from the wellbore with the first packer set and the backup packer unset; and setting the backup packer in the wellbore in response to a signal on the second control line.

Embodiments of the method for controlling fluids in a wellbore can include one or more of the following features.

In some embodiments, the method includes running the production string into the wellbore including running the production string into the wellbore with a protective sleeve covering the backup packer. In some cases, the method includes removing the protective sleeve from the backup packer before setting the backup packer.

In some embodiments, the method includes electrically setting the first packer.

In some embodiments, the method includes hydraulically setting the backup packer. In some cases, the method includes setting the first packer in the wellbore in response to a signal on the first control line. In some cases, the method includes setting the backup packer in the wellbore in response to a signal on the second control line. In some cases, the method includes the signal on the second control line sent in response to a pressure applied to the backup packer. In some cases, the method includes monitoring the condition of the wellbore by reporting if the wellbore is in a stable or an unstable condition. In some cases, the unstable condition of the method includes an unintentional flow of a formation fluid from one formation into another formation or to a surface.

In some embodiments, the method includes after running the production string into the wellbore, the backup packer is positioned between 500 ft and 1500 ft downhole from ground surface.

In some aspects, a system for controlling fluids in a wellbore, includes a production tubing including one or more set packers intermittently disposed from the production tubing throughout the wellbore; one or more inactive backup packers intermittently disposed from the production tubing throughout the wellbore; a first control line operable to set the one or more packers in response to a signal; a second control line operable to set the one or more inactive backup packers in response to a signal; and an onboard electronic equipment in electronic communication with the production tubing and operable to monitor and to report a condition of the wellbore.

Embodiments of the system for determining sweet spots and ranking a basin in a subterranean formation can include one or more of the following features.

In some embodiments, the system includes the production string with one or more protective sleeves covering the one or more backup packers. In some cases, the system includes a shifting tool configured to remove one or more protective sleeves covering the one or more backup packers before setting the one or more backup packers.

The described approach for controlling fluids in a wellbore using a backup packer can also be used as protection between casings. For example, a casing-to-casing pressure buildup can take years into the life of the wellbore to develop. The method of using a backup packer is a safe and reliable approach for securing the wellbore from potential issues and complying with standards for barriers installation. The described approach can be used as a safety practice in wellbores with a freezing plug.

The details of one or more embodiments of these methods are set forth in the accompanying drawings and the description below. Other features, objects, and advantages of these methods will be apparent from the description, drawings, and claims.

DETAILED DESCRIPTION

This specification describes methods and systems for controlling fluids in a wellbore using a backup packer. The backup packer can serve as a barrier in a completion string to control the flow of fluids and extend the life of the wellbore. Initially, the backup packer on the completion string is placed unset/inactive at a shallow depth and remains inactive until it is needed to be run on wellbores in the future. To prevent permanently setting the backup packer, the system includes a separate, second control line for the backup packer. The backup packer can be run and set electrically (e.g., actuated by using wirelines) or hydraulically by applying pressure through a separate, second control line. The backup packer can include an elastomeric protective sleeve that can be removed before running the packer. The sleeve can be shifted using a shifting tool and the packer would function as a backup packer at the time. The protective sleeve will allow the packer to last for the long run life of the wellbore. The backup packer can be a part of the completion assembly that is installed in the wellbore but remains inactive till is needed. This approach allows the backup packer to be left inactive in the hole for future use and for securing the wellbore long term.

Having a backup packer to control fluids in a wellbore can improve production rate, extend wellbore life, reduce the amount of equipment and trips that need to be run downhole, and prevent additional challenges associated with wellbore operations.

Figure 1:
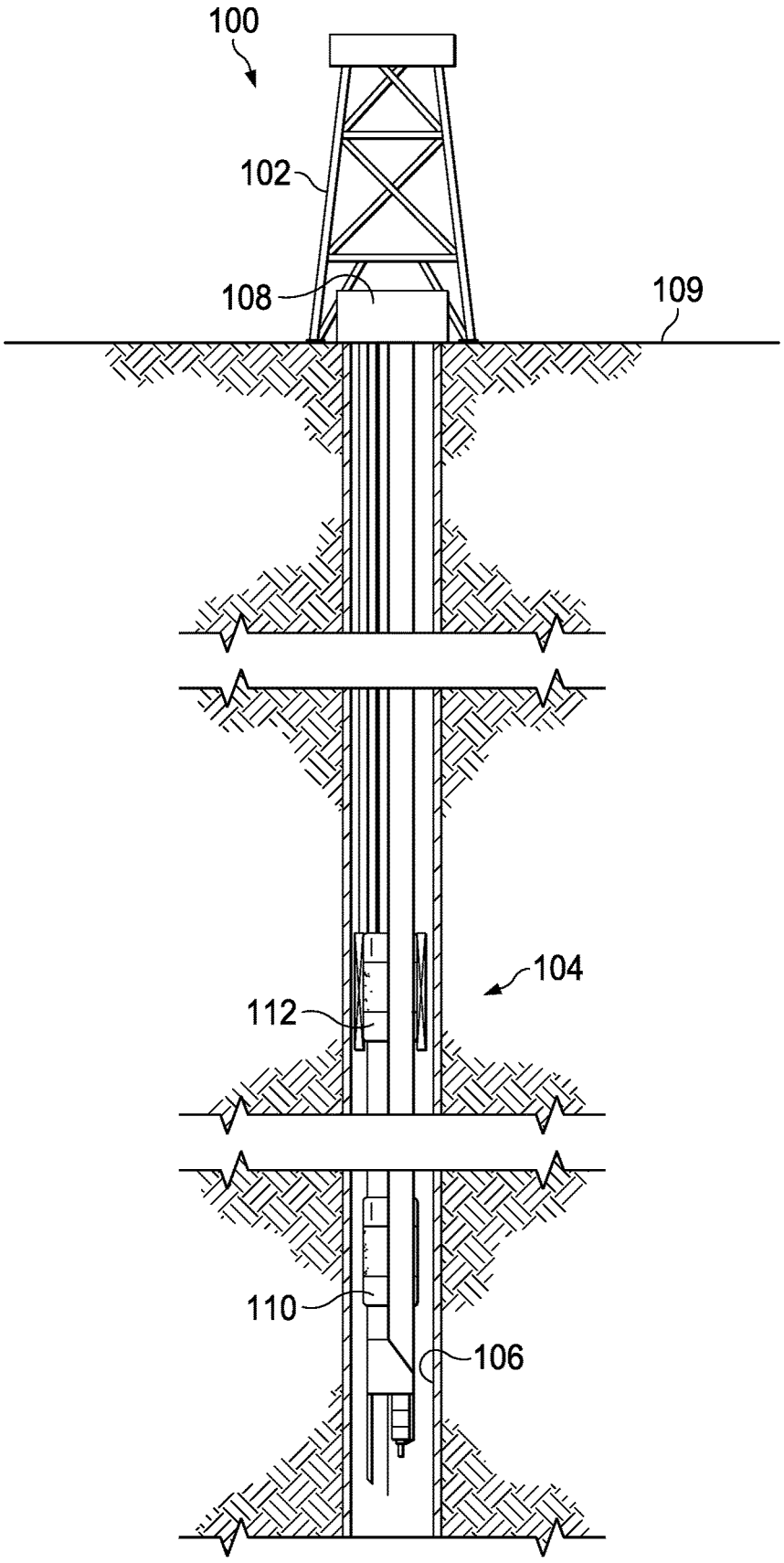
FIG. 1 is a schematic view of a wellbore with a production system including a backup packer.

FIG. 1 is a schematic view of a wellbore 100 with a production string 104 including a backup packer 112. The wellbore 100 site includes a derrick 102 that supports the production string 104 within a wellbore 106. The production string 104 includes a production tubing run on a completion string from a wellbore head 108 at the wellbore surface 109. The production string 104 includes a first packer 110 that is electrically actuated to seal the annulus between the completion string and the casing and for directing wellbore production through the completion string. The production string 104 also includes an unset, backup packer 112 positioned between 500 ft and 1500 ft downhole from the ground surface. The backup packer 112 can be electrically set for future use in the wellbore 106. In some implementations, the unset, backup packer 112 is hydraulically set for future use in the wellbore 106. In some implementations, multiple packers are intermittently disposed from the production string 104, which runs throughout the wellbore 106 to isolate various wellbore zones. In this example, the production string 104 can also include the backup packer 112 placed inactive at a shallow depth in wellbore 106 for future use.

Figure 2:
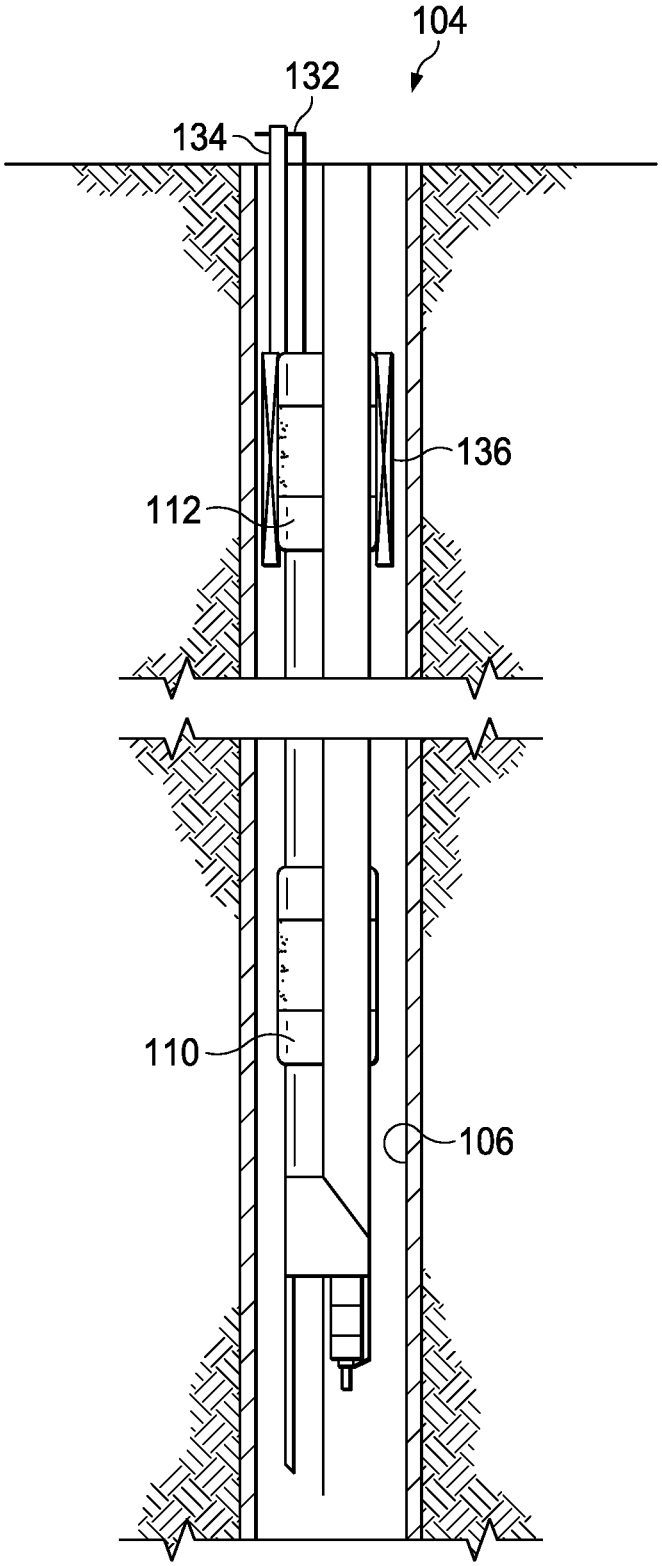
FIG. 2 is a schematic view of an example production string with a backup packer.

FIG. 2 is a schematic view of an example production string 104 with a backup packer 112. The backup packer can serve as a barrier in a completion string, which is part of the production string 104, to control the flow of fluids and extend the life of the wellbore 100. Initially, once the completion string is in place, the backup packer 112 is placed unset/inactive at a shallow depth and remains inactive until it is needed to be run on wellbores in the future. The backup packer 112 is connected to a separate or second control line 132 that allows the backup packer 112 to be activated in response to a signal received through the second control line 132 at the time of need. In some implementations, the backup packer 112 is triggered electrically and set by pressurizing the second control line 132. In other implementations, the backup packer 112 is activated hydraulically and set by pressurizing the second control line 132. The second control line 132 is provided above the packer 112. The production string 104 can include an electrical line or first control line 134 (e.g., encapsulated conductor line) that facilitates electrical communications between pressure monitoring equipment and other equipment at the wellbore surface 109. The first control line 134 is wired to the first packer 110 and allows the setting of the first packer 110 in response to a signal received through the first control line 134. In some implementations, the first control line 134 is wired to the backup packer 112 and configured to initiate electrical actuation of the backup packer 112. In this manner, the setting and actuating mechanism for the backup packer 112 can be directed from the surface over lines 132 and 134. The setting mechanism of the packer is by applying a pressure from surface to unset packer if needed. The control line 132 can be provided with a J slot (not shown) to set the backup packer 112 when is needed. In some implementations, the J slot, as part of the production string 104, can cooperate with connecting elements (e.g., lugs) on a rotating element (e.g., a mandrel) for setting the backup packer 112, for releasing the backup packer 112, or for enabling the backup packer 112 to be readily converted from unset to set state by a wellbore string if desired. In some implementations, the J slot can enable the backup packer 112 to function as a bridge plug, a production packer, a test packer, a treating packer, multiple string packers, a seal bore packer, and a compression or tension wellbore string anchor.

In the field, it can take years into the life of the wellbore for the backup packer to be activated and used. The backup packer 112 is dressed with a protective sleeve 136. The protective sleeve 136 includes a durable material (e.g., elastomer) that can protect the backup packer 112 from corrosion, moisture invasion, cracks, breakage, material loss, and can effectively manage heat gain/loss and condensation control for the life of the backup packer 112. The protective sleeve can protect the seal bore from wire damage. The protective sleeve 136 can include a receiving slot to receive a shifting tool (e.g., sliding sleeves) and be removed from the backup packer 112 when it is time for the backup packer 112 to be activated and used. The production tubing from the production string 104 is releasably connected to the backup packer 112 using a mechanical lock (e.g., a stinger) (not shown). The wellbore can be flowed through the backup packer 112 to the production tubing, or treated through the tubing and the backup packer 112. The production string 104 and the backup packer 112 can then be retrievable when desired.

Figure 3:
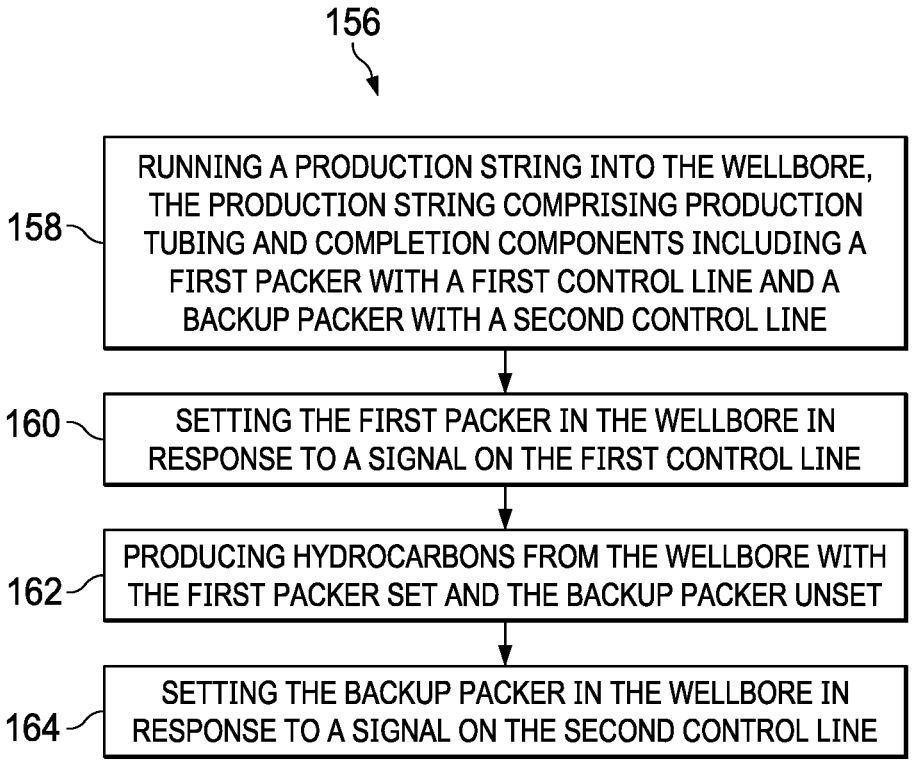
FIG. 3 is a flowchart showing a method for controlling fluids in a wellbore using a backup packer.

FIG. 3 is a flowchart showing a method 156 for controlling fluids in a wellbore using a backup packer 112. In operation, a production string is run into the wellbore and includes production tubing and completion components such as a first packer with a first control line and a backup packer with a second control line (158). The packers are used as a seal between the outside of the production tubing and the inside of the casing, liner, or wellbore wall. In wellbores with multiple reservoir zones, packers are used to isolate the perforations for each zone and to control the fluid flow within the zones. After the production string is deployed the first packer is set in response to a signal on the first control line (160). Then production of hydrocarbons begins with the first packer set and the backup packer unset or left inactive (162). During the hydrocarbons production, the condition of the wellbore is monitored and inspected by obtaining wellbore data continuously. The data is obtained through communication between an electric line that is part of the tubing assembly, and the equipment on the surface. The user can evaluate the condition of the wellbore condition by analyzing the collected data. In the event when the condition of the wellbore is unstable (e.g., with hydrocarbon overflow from one zone to another or the surface) the second control line is triggered to initiate the setting of the backup packer in response to a signal received (164). The setting mechanism can be an electrical or a hydraulic mechanism. The backup packer serves as a barrier in a completion string for the long-term life of the wellbore. In the event when the condition of the wellbore remains stable, the backup packer is maintained in the inactive state for the long-term life of the wellbore, and the wellbore is continuously monitored. In the event when the condition of the wellbore is not stable (e.g., with hydrocarbon overflow from one zone into another or at the surface) a protective sleeve is removed from the backup packer using a shifting tool, and the separate control line is directed to initiate setting the backup packer using an electrical or a hydraulic mechanism. In general, the same electrical or separate control line may be utilized in supporting communications with the electronic equipment on the surface for continuous monitoring of the condition of the wellbore.

The described approach for controlling fluids in a wellbore using an inactive backup packer with a separate control line reduces the likelihood of having to remove and/or re-deploy an entire production string when a future need arises. Furthermore, setting techniques for the backup packer as described utilize a separate control line that may already be in place as part of a sensing or electronic equipment deployed with the production string at the start of the completions process. The production string in the completion assembly which include the packer are connected through a control line that can establish a communication with equipment at surface.

Figure 4:
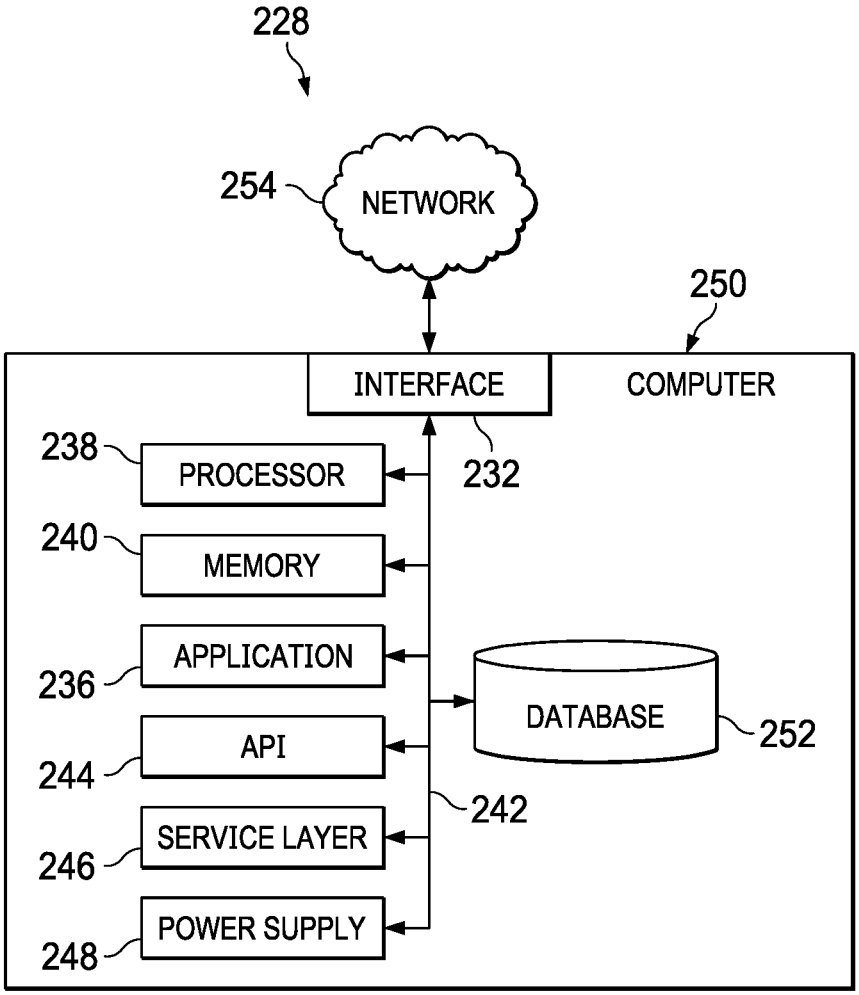
FIG. 4 is a block diagram of an example computer system.

FIG. 4 is a block diagram of an example computer system 266 used to provide computational functionalities associated with described algorithms, methods, functions, processes, flows, and procedures described in the present disclosure, according to some implementations of the present disclosure. The illustrated computer 266 is intended to encompass any computing device such as a server, a desktop computer, a laptop/notebook computer, a wireless data port, a smartphone, a personal data assistant (PDA), a tablet computing device, or one or more processors within these devices, including physical instances, virtual instances, or both. The computer 266 can include input devices such as keypads, keyboards, and touch screens that can accept user information. Also, the computer 266 can include output devices that can convey information associated with the operation of the computer 266. The information can include digital data, visual data, audio information, or a combination of information. The information can be presented in a graphical user interface (UI) (or GUI).

The computer 266 can serve in a role as a client, a network component, a server, a database, a persistency, or components of a computer system for performing the subject matter described in the present disclosure. The illustrated computer 266 is communicably coupled with a network 264. In some implementations, one or more components of the computer 266 can be configured to operate within different environments, including cloud-computing-based environments, local environments, global environments, and combinations of environments.

At a high level, the computer 266 is an electronic computing device operable to receive, transmit, process, store, and manage data and information associated with the described subject matter. According to some implementations, the computer 266 can also include, or be communicably coupled with, an application server, an email server, a web server, a caching server, a streaming data server, or a combination of servers.

The computer 266 can receive requests over network 264 from a client application (for example, executing on another computer 266). The computer 266 can respond to the received requests by processing the received requests using software applications. Requests can also be sent to the computer 266 from internal users (for example, from a command console), external (or third) parties, automated applications, entities, individuals, systems, and computers. Each of the components of the computer 266 can communicate using a system bus 564. In some implementations, any or all of the components of the computer 266, including hardware or software components, can interface with each other or the interface 268 (or a combination of both), over the system bus 564. Interfaces can use an application programming interface (API) 276, a service layer 278, or a combination of the API 276 and service layer 278. The API 276 can include specifications for routines, data structures, and object classes. The API 276 can be either computer-language independent or dependent. The API 276 can refer to a complete interface, a single function, or a set of APIs.

The service layer 278 can provide software services to the computer 266 and other components (whether illustrated or not) that are communicably coupled to the computer 266. The functionality of the computer 266 can be accessible for all service consumers using this service layer. Software services, such as those provided by the service layer 278, can provide reusable, defined functionalities through a defined interface. For example, the interface can be software written in JAVA, C++, or a language providing data in extensible markup language (XML) format. While illustrated as an integrated component of the computer 266, in alternative implementations, the API 276 or the service layer 278 can be stand-alone components in relation to other components of the computer 266 and other components communicably coupled to the computer 266. Moreover, any or all parts of the API 276 or the service layer 278 can be implemented as child or sub-modules of another software module, enterprise application, or hardware module without departing from the scope of the present disclosure.

The computer 266 includes an interface 268. Although illustrated as a single interface 268 in FIG. 4, two or more interfaces 268 can be used according to particular needs, desires, or particular implementations of the computer 266 and the described functionality. The interface 268 can be used by the computer 266 for communicating with other systems that are connected to the network 264 (whether illustrated or not) in a distributed environment. Generally, the interface 268 can include, or be implemented using, logic encoded in software or hardware (or a combination of software and hardware) operable to communicate with the network 264. More specifically, the interface 268 can include software supporting one or more communication protocols associated with communications. As such, the network 264 or the interface's hardware can be operable to communicate physical signals within and outside of the illustrated computer 266.

The computer 266 includes a processor 270. Although illustrated as a single processor 270 in FIG. 4, two or more processors 270 can be used according to particular needs, desires, or particular implementations of the computer 266 and the described functionality. Generally, the processor 270 can execute instructions and can manipulate data to perform the operations of the computer 266, including operations using algorithms, methods, functions, processes, flows, and procedures as described in the present disclosure.

The computer 266 also includes a database 282 that can hold data for the computer 266 and other components connected to the network 264 (whether illustrated or not). For example, database 282 can be an in-memory, conventional, or a database storing data consistent with the present disclosure. In some implementations, database 282 can be a combination of two or more different database types (for example, hybrid in-memory and conventional databases) according to particular needs, desires, or particular implementations of the computer 266 and the described functionality. Although illustrated as a single database 282 in FIG. 4, two or more databases (of the same, different, or combination of types) can be used according to particular needs, desires, or particular implementations of the computer 266 and the described functionality. While database 282 is illustrated as an internal component of the computer 266, in alternative implementations, database 282 can be external to the computer 266.

The computer 266 also includes a memory 272 that can hold data for the computer 266 or a combination of components connected to the network 264 (whether illustrated or not). Memory 272 can store any data consistent with the present disclosure. In some implementations, memory 272 can be a combination of two or more different types of memory (for example, a combination of semiconductor and magnetic storage) according to particular needs, desires, or particular implementations of the computer 266 and the described functionality. Although illustrated as a single memory 272 in FIG. 4, two or more memories 272 (of the same, different, or combination of types) can be used according to particular needs, desires, or particular implementations of the computer 266 and the described functionality. While memory 272 is illustrated as an internal component of the computer 266, in alternative implementations, memory 272 can be external to the computer 266.

The application 274 can be an algorithmic software engine providing functionality according to particular needs, desires, or particular implementations of the computer 266 and the described functionality. For example, application 274 can serve as one or more components, modules, or applications. Further, although illustrated as a single application 274, the application 274 can be implemented as multiple applications 274 on the computer 266. In addition, although illustrated as internal to the computer 266, in alternative implementations, the application 274 can be external to the computer 266.

The computer 266 can also include a power supply 280. The power supply 280 can include a rechargeable or non-rechargeable battery that can be configured to be either user- or non-user-replaceable. In some implementations, the power supply 280 can include power-conversion and management circuits, including recharging, standby, and power management functionalities. In some implementations, the power-supply 280 can include a power plug to allow the computer 266 to be plugged into a wall socket or a power source to, for example, power the computer 266 or recharge a rechargeable battery.

There can be any number of computers 266 associated with, or external to, a computer system containing computer 266, with each computer 266 communicating over network 264. Further, the terms "client," "user," and other appropriate terminology can be used interchangeably, as appropriate, without departing from the scope of the present disclosure. Moreover, the present disclosure contemplates that many users can use one computer 266 and one user can use multiple computers 266.

Implementations of the subject matter and the functional operations described in this specification can be implemented in digital electronic circuitry, intangibly embodied computer software or firmware, in computer hardware, including the structures disclosed in this specification and their structural equivalents, or in combinations of one or more of them. Software implementations of the described subject matter can be implemented as one or more computer programs. Each computer program can include one or more modules of computer program instructions encoded on a tangible, non-transitory, computer-readable computer-storage medium for execution by, or to control the operation of, data processing apparatus. Alternatively, or additionally, the program instructions can be encoded in/on an artificially-generated propagated signal. The example, the signal can be a machine-generated electrical, optical, or electromagnetic signal that is generated to encode information for transmission to suitable receiver apparatus for execution by a data processing apparatus. The computer-storage medium can be a machine-readable storage device, a machine-readable storage substrate, a random or serial access memory device, or a combination of computer-storage mediums.

The terms "data processing apparatus," "computer," and "electronic computer device" (or equivalent as understood by one of ordinary skill in the art) refer to data processing hardware. For example, a data processing apparatus can encompass all kinds of apparatus, devices, and machines for processing data, including by way of example, a programmable processor, a computer, or multiple processors or computers. The apparatus can also include special purpose logic circuitry including, for example, a central processing unit (CPU), a field programmable gate array (FPGA), or an application specific integrated circuit (ASIC). In some implementations, the data processing apparatus or special purpose logic circuitry (or a combination of the data processing apparatus or special purpose logic circuitry) can be hardware- or software-based (or a combination of both hardware- and software-based). The apparatus can optionally include code that creates an execution environment for computer programs, for example, code that constitutes processor firmware, a protocol stack, a database management system, an operating system, or a combination of execution environments. The present disclosure contemplates the use of data processing apparatuses with or without conventional operating systems, for example LINUX, UNIX, WINDOWS, MAC OS, ANDROID, or IOS.

A computer program, which can also be referred to or described as a program, software, a software application, a module, a software module, a script, or code, can be written in any form of programming language. Programming languages can include, for example, compiled languages, interpreted languages, declarative languages, or procedural languages. Programs can be deployed in any form, including as stand-alone programs, modules, components, subroutines, or units for use in a computing environment. A computer program can, but need not, correspond to a file in a file system. A program can be stored in a portion of a file that holds other programs or data, for example, one or more scripts stored in a markup language document, in a single file dedicated to the program in question, or in multiple coordinated files storing one or more modules, sub programs, or portions of code. A computer program can be deployed for execution on one computer or on multiple computers that are located, for example, at one site or distributed across multiple sites that are interconnected by a communication network. While portions of the programs illustrated in the various figures may be shown as individual modules that implement the various features and functionality through various objects, methods, or processes, the programs can instead include a number of sub-modules, third-party services, components, and libraries. Conversely, the features and functionality of various components can be combined into single components as appropriate. Thresholds used to make computational determinations can be statically, dynamically, or both statically and dynamically determined.

The methods, processes, or logic flows described in this specification can be performed by one or more programmable computers executing one or more computer programs to perform functions by operating on input data and generating output. The methods, processes, or logic flows can also be performed by, and apparatus can also be implemented as, special purpose logic circuitry, for example, a CPU, an FPGA, or an ASIC.

Computers suitable for the execution of a computer program can be based on one or more of general and special purpose microprocessors and other kinds of CPUs. The elements of a computer are a CPU for performing or executing instructions and one or more memory devices for storing instructions and data. Generally, a CPU can receive instructions and data from (and write data to) a memory. A computer can also include, or be operatively coupled to, one or more mass storage devices for storing data. In some implementations, a computer can receive data from, and transfer data to, the mass storage devices including, for example, magnetic, magneto optical disks, or optical disks. Moreover, a computer can be embedded in another device, for example, a mobile telephone, a personal digital assistant (PDA), a mobile audio or video player, a game console, a global positioning system (GPS) receiver, or a portable storage device such as a universal serial bus (USB) flash drive.

Computer readable media (transitory or non-transitory, as appropriate) suitable for storing computer program instructions and data can include all forms of permanent/non-permanent and volatile/non-volatile memory, media, and memory devices. Computer readable media can include, for example, semiconductor memory devices such as random access memory (RAM), read only memory (ROM), phase change memory (PRAM), static random access memory (SRAM), dynamic random access memory (DRAM), erasable programmable read-only memory (EPROM), electrically erasable programmable read-only memory (EEPROM), and flash memory devices. Computer readable media can also include, for example, magnetic devices such as tape, cartridges, cassettes, and internal/removable disks. Computer readable media can also include magneto optical disks and optical memory devices and technologies including, for example, digital video disc (DVD), CD ROM, DVD+/−R, DVD-RAM, DVD-ROM, HD-DVD, and BLU-RAY. The memory can store various objects or data, including caches, classes, frameworks, applications, modules, backup data, jobs, web pages, web page templates, data structures, database tables, repositories, and dynamic information. Types of objects and data stored in memory can include parameters, variables, algorithms, instructions, rules, constraints, and references. Additionally, the memory can include logs, policies, security or access data, and reporting files. The processor and the memory can be supplemented by, or incorporated in, special purpose logic circuitry.

Implementations of the subject matter described in the present disclosure can be implemented on a computer having a display device for providing interaction with a user, including displaying information to (and receiving input from) the user. Types of display devices can include, for example, a cathode ray tube (CRT), a liquid crystal display (LCD), a light-emitting diode (LED), and a plasma monitor. Display devices can include a keyboard and pointing devices including, for example, a mouse, a trackball, or a trackpad. User input can also be provided to the computer through the use of a touchscreen, such as a tablet computer surface with pressure sensitivity or a multi-touch screen using capacitive or electric sensing. Other kinds of devices can be used to provide for interaction with a user, including to receive user feedback, for example, sensory feedback including visual feedback, auditory feedback, or tactile feedback. Input from the user can be received in the form of acoustic, speech, or tactile input. In addition, a computer can interact with a user by sending documents to, and receiving documents from, a device that is used by the user. For example, the computer can send web pages to a web browser on a user's client device in response to requests received from the web browser.

The term "graphical user interface," or "GUI," can be used in the singular or the plural to describe one or more graphical user interfaces and each of the displays of a particular graphical user interface. Therefore, a GUI can represent any graphical user interface, including, but not limited to, a web browser, a touch screen, or a command line interface (CLI) that processes information and efficiently presents the information results to the user. In general, a GUI can include a plurality of user interface (UI) elements, some or all associated with a web browser, such as interactive fields, pull-down lists, and buttons. These and other UI elements can be related to or represent the functions of the web browser.

Implementations of the subject matter described in this specification can be implemented in a computing system that includes a back end component, for example, as a data server, or that includes a middleware component, for example, an application server. Moreover, the computing system can include a front-end component, for example, a client computer having one or both of a graphical user interface or a Web browser through which a user can interact with the computer. The components of the system can be interconnected by any form or medium of wireline or wireless digital data communication (or a combination of data communication) in a communication network. Examples of communication networks include a local area network (LAN), a radio access network (RAN), a metropolitan area network (MAN), a wide area network (WAN), Worldwide Interoperability for Microwave Access (WIMAX), a wireless local area network (WLAN) (for example, using 802.11 a/b/g/n or 802.20 or a combination of protocols), all or a portion of the Internet, or any other communication system or systems at one or more locations (or a combination of communication networks). The network can communicate with, for example, Internet Protocol (IP) packets, frame relay frames, asynchronous transfer mode (ATM) cells, voice, video, data, or a combination of communication types between network addresses.

The computing system can include clients and servers. A client and server can generally be remote from each other and can typically interact through a communication network. The relationship of client and server can arise by virtue of computer programs running on the respective computers and having a client-server relationship.

Cluster file systems can be any file system type accessible from multiple servers for read and update. Locking or consistency tracking may not be necessary since the locking of exchange file system can be done at application layer. Furthermore, Unicode data files can be different from non-Unicode data files.

While this specification contains many specific implementation details, these should not be construed as limitations on the scope of what may be claimed, but rather as descriptions of features that may be specific to particular implementations. Certain features that are described in this specification in the context of separate implementations can also be implemented, in combination, in a single implementation. Conversely, various features that are described in the context of a single implementation can also be implemented in multiple implementations, separately, or in any suitable sub-combination. Moreover, although previously described features may be described as acting in certain combinations and even initially claimed as such, one or more features from a claimed combination can, in some cases, be excised from the combination, and the claimed combination may be directed to a sub-combination or variation of a sub-combination.

Particular implementations of the subject matter have been described. Other implementations, alterations, and permutations of the described implementations are within the scope of the following claims as will be apparent to those skilled in the art. While operations are depicted in the drawings or claims in a particular order, this should not be understood as requiring that such operations be performed in the particular order shown or in sequential order, or that all illustrated operations be performed (some operations may be considered optional), to achieve desirable results. In certain circumstances, multitasking or parallel processing (or a combination of multitasking and parallel processing) may be advantageous and performed as deemed appropriate.

Moreover, the separation or integration of various system modules and components in the previously described implementations should not be understood as requiring such separation or integration in all implementations, and it should be understood that the described program components and systems can generally be integrated together in a single software product or packaged into multiple software products.

Accordingly, the previously described example implementations do not define or constrain the present disclosure. Other changes, substitutions, and alterations are also possible without departing from the spirit and scope of the present disclosure.

Furthermore, any claimed implementation is considered to be applicable to at least a computer-implemented method; a non-transitory, computer-readable medium storing computer-readable instructions to perform the computer-implemented method; and a computer system comprising a computer memory interoperably coupled with a hardware processor configured to perform the computer-implemented method or the instructions stored on the non-transitory, computer-readable medium.

A number of embodiments of these systems and methods have been described. Nevertheless, it will be understood that various modifications may be made without departing from the spirit and scope of this disclosure. Accordingly, other embodiments are within the scope of the following claims.

What is claimed is:

1. A method for controlling fluids in a wellbore, the method comprising:

running a production string into the wellbore, the production string comprising production tubing and completion components including a first packer with a first control line and a backup packer with a second control line;

setting the first packer in the wellbore in response to a signal on the first control line;

producing hydrocarbons from the wellbore with the first packer set and the backup packer unset; and setting the backup packer in the wellbore in response to a signal on the second control line, wherein the signal on the second control line to set the backup packer is sent in response to a pressure applied to the backup packer.

2. The method of claim 1, wherein running the production string into the wellbore comprises running the production string into the wellbore with a protective sleeve covering the backup packer.

3. The method of claim 2, further comprising removing the protective sleeve from the backup packer before setting the backup packer.

4. The method of claim 1, wherein setting the first packer comprises electrically setting the first packer.

5. The method of claim 1, wherein setting the backup packer comprises hydraulically setting the backup packer.

6. The method of claim 1, wherein, after running the production string into the wellbore, the backup packer is positioned between 500 ft and 1500 ft downhole from ground surface.

7. The method of claim 1, further comprising monitoring a condition of the wellbore by reporting if the wellbore is in a stable or an unstable condition.

8. The method of claim 7, wherein the unstable condition includes an unintentional flow of a formation fluid from one formation, into another formation or, to a surface.

* * * * *